US011091932B2

(12) United States Patent
Hoggan

(10) Patent No.: US 11,091,932 B2
(45) Date of Patent: Aug. 17, 2021

(54) DUAL-WINGED SLAT

(71) Applicant: Patrick R. Hoggan, North Logan, UT (US)

(72) Inventor: Patrick R. Hoggan, North Logan, UT (US)

( * ) Notice: Subject to any disclaimer, the term of this patent is extended or adjusted under 35 U.S.C. 154(b) by 0 days.

(21) Appl. No.: 14/973,323

(22) Filed: Dec. 17, 2015

(65) Prior Publication Data

US 2018/0128008 A1 May 10, 2018

(51) Int. Cl.
*E04H 17/06* (2006.01)

(52) U.S. Cl.
CPC ..... *E04H 17/066* (2013.01)

(58) Field of Classification Search
CPC ..... E04H 17/02; E04H 17/06; E04H 17/066; E04H 17/04
See application file for complete search history.

(56) References Cited

U.S. PATENT DOCUMENTS 5,584,468 A * 12/1996 Meglino ..... E04H 17/066 256/32
5,775,676 A * 7/1998 Hoggan ..... E04H 17/066 256/32
6,164,628 A * 12/2000 Hoggan ..... E04H 17/066 256/32
2002/0113232 A1* 8/2002 Torres ..... E04H 17/066 256/34
2008/0135820 A1* 6/2008 Hoggan ..... E04H 17/066 256/1

* cited by examiner

*Primary Examiner* — Michael P Ferguson
(74) *Attorney, Agent, or Firm* — Preston P. Frischknecht; Project CIP

(57) ABSTRACT

A dual-winged slat having a rectangular body further possesses a straight fin and an angled fin on each edge of the body with the free end of the angled fin being angled toward the face of the body which is farther from the place of attachment of the angled fin to the edge. The free end of each straight fin must be closer to the face of the body nearer where the first end of the straight fin is attached to the edge than is the free end of the angled fin on the same edge. No fin may be attached to the edge of the slat more than halfway to the face toward which the angled fin is directed. The fins are preferably asymmetrically arranged. And, also preferable, the straight fin and the angled fin attached to a given edge are attached at the same place.

26 Claims, 6 Drawing Sheets

DUAL-WINGED SLAT

BACKGROUND OF THE INVENTION

Field of the Invention

This invention relates to slats which are inserted into chain link fences in order to increase privacy and security.

Description of the Related Art

The slat of U.S. Pat. No. 6,634,623 possesses a body member 19 having a front surface 28, a parallel rear surface 30, and two shorter connecting parallel sides 27 and 29. Fins 21 and 22 may originate (a) near the centers of sides 27 and 29 or (b) from opposite corners of a side 27 or 29 and the front surface 28 or the rear surface 30. But the fins 21 and 22 do not originate from any intermediate point between the center of a side 27 or 29 and a surface (front 28 or rear 30).

Each of the fins 21 and 22 extends at an acute angle relative to its respective side of origination 27 or 29 to reach the plane of the surface 28 or 30 toward which such fin 21 or 22 is angled.

The slat of U.S. Pat. No. 6,634,623 has, however, no straight fin.

Lines 16 through 26 in column 2 of U.S. Pat. No. 6,164,628 indicate, "For purposes of providing privacy and providing a self-locking slat that is automatically securable in a channel of a chain link fence . . . first and second fins [20a and 20b] may extend from and along longitudinal sides of the body member, proximate a proximal [toward the front side of the chain link fence 16, according to lines 12 through 13 of column 4] face sheet . . . of the body member, laterally and proximately, toward and into the knuckles of the chain link fence to frictionally engage the knuckles, and specifically, the twisted wires at intersections of the wire mesh fencing fabric." Line 65 of column 4 through line 4 of column 5 further explain, " . . . the fins 20a, 20b are configured to extend proximately, relative to the body member 24. In particular, and relative to a proximal face sheet 26 of the body member 24, the fins 20a, 20b are oriented at an angle, [$\alpha$], the angle being between about 0° and about 30° and, more preferably, between about 0° and 20°, and in a preferred embodiment between, between about 5° and 15°."

Further, according to lines 41 through 51 of column 2, "In another embodiment of the present invention, the . . . slats further include third and fourth fins for inhibiting rotational movement of the slat relative to the channel [of a chain link fence]. More specifically, in this embodiment, third and fourth fins extending along and from longitudinal sides of the body member, proximate a distal [toward a back side or face of the chain link fence, according to lines 10 through 11 of column 4] face sheet . . . of the body member, are provided to abuttingly engage distal portions of the wire mesh fencing fabric to inhibit rotational movement of the slats within corresponding channels.

Lines 13 through 21 in column 5 continue, "In particular, and as illustrated in FIGS. 1, 3-5, fins 30a, 30b extend at least laterally outwardly toward knuckles 18, and extend distally, relative to the body member 24, to engage distal portions 14b of the wire and mesh fencing fabric 14. In one embodiment, the fins 30a, 30b are oriented at an angle, $\beta$, relative to a distal face sheet 28 of the body member 24, the angle $\beta$ being between about 35° and 55° and, more preferably, between about 40° and 50°.

Therefore, the slat of U.S. Pat. No. 6,164,628 can have an angled fin and a straight fin on each side of the body member, but the fins are not asymmetrically arranged, i.e., as defined herein the straight fins are not diagonally opposite to one another, and the angled fins are not diagonally opposite to one another; if straight fins exist, the angled fins do not have their respective free ends angled toward opposite faces of the slat; an angled fin and a straight fin are not attached at the same place to the body member; and no fin is attached to the body member other than at a corner, i.e., as defined herein, where a side meets a face.

The fins of the slat in U.S. Pat. Nos. 5,584,468 and 5,899,442 can, according to lines 60 through 61 in column 4 of U.S. Pat. No. 5,584,468 and the identically worded statement in lines 62 through 64 from column 4 in U.S. Pat. No. 5,899,442, on each side be angled toward or away from each other; but there is no indication in either patent (1) that the angled fins are diagonally opposite to one another simultaneously with straight fins being diagonally opposite to one another, i.e., there is no indication that fins comprising a set of two angled fins and a set of two straight fins are asymmetrical or (2) that any two fins originate from the same place on a given side of the slat.

And there is no indication of any angled fin in U.S. Pat. No. 5,806,839.

The inventor is, moreover, unaware of any fence slat having an angled fin and a straight fin originating from a given side of a slat wherein the angled slat originally proceeds perpendicularly to the side of the slat before extending at an angle from such perpendicular portion.

BRIEF SUMMARY OF THE INVENTION

The Dual-winged Slat of the present invention has a rectangular body comprising a front face, a rear face, a first edge (also termed a "side"), and a second edge. It further comprises a straight fin (also termed a "wing") and an angled fin on each edge with the free end of the angled fin being angled (in the transverse plane with respect to the body of the slat) toward the face of the body which is farther from the place of attachment of the angled fin to the edge; as is traditional for fins and slats, the attachment of the fins to the body of the slat extends longitudinally along the edges of the slat. The body may be either solid or hollow. If the body is hollow, the body preferably contains at least one, and most preferably two, internal walls which are parallel to the edges of the body and connected at the tops and bottoms of the walls to the front face and to the rear face of the body of the slat.

The free end of the first straight fin must be closer to the plane containing the front face of the slat than is the free end of the first angled fin which originates from the same edge of the slat as does the first straight fin, i.e., the first edge. And the free end of the second straight fin must be closer to the plane containing the rear face of the slat than is the free end of the second angled fin, which originates from the same edge of the slat as does the second straight fin, i.e., the second edge.

No fin may be attached to the edge of the slat more than halfway to the face toward which the angled fin is directed.

Preferably, the straight fin and the angled fin attached to a given edge of the body of the slat are attached to such edge at the same place.

The fins are, also preferably, asymmetrically arranged, i.e., the straight fin on a first edge, i.e., the first straight fin, of the slat is diagonally opposite to the straight fin on the second edge of the slat, i.e., the second straight fin; and the angled fin on a first edge of the slat, i.e., the first angled fin, is diagonally opposite to the angled fin on the second edge of the slat, i.e., the second angled fin.

Preferably, for the angled fin and the straight fin which are closer to the front face, i.e., the first straight fin and the first angled fin, the first angled fin rides along the outer rear portion of the first left-opening curved knuckle, the free end of the first angled fin touches the inside of the first right-opening curved knuckle, and the first straight fin must be outside but near (and, most preferably, touch) the front outer portion of the first left-opening curved knuckle. Also preferably, for the angled fin and the straight fin which are closer to the rear face, i.e., the second angled fin and the second straight fin, the second angled fin rides along the outer front portion of the second right-opening curved knuckle, the free end of the second angled fin touches the inside of the second left-opening curved knuckle, and the second straight fin must be outside but near (and, most preferably, touch) the rear outer portion of the second right-opening curved knuckle.

And, optionally, for either or both angled fins the first portion, i.e., the portion attached to the edge may be perpendicular to the edge while the second portion, i.e., the portion associated with the free end of the angled fin, is angled toward the face of the slat which is farther from the point of attachment of the angled fin to the edge.

DETAILED DESCRIPTION OF THE INVENTION

Figure 1:
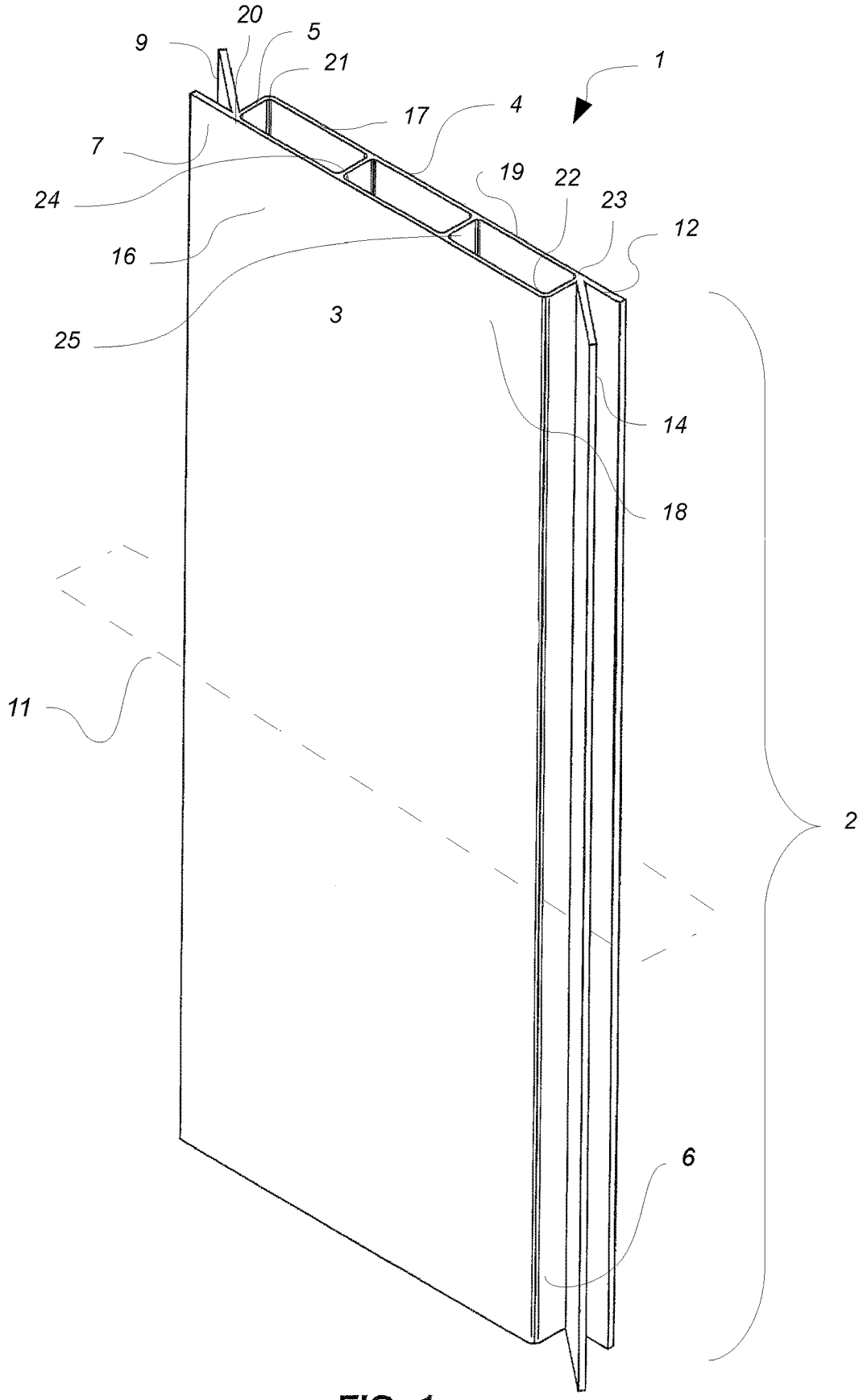
FIG. 1 is a perspective view of a preferred embodiment for the Dual-winged Slat.

As stated above and as illustrated in FIGS. 1 through 11, the Dual-winged Slat 1 of the present invention has a rectangular body 2 comprising a front face 3, a rear face 4, a first edge 5, and a second edge 6. There is, further, a first straight fin 7 having a first end 8 and a first angled fin 9 having a first end 10 with each of the first ends 8, 10 attached to the first edge 5 with the first end 10 of the first angled fin 9 being no closer to the front face 3 than is the first end 8 of the first straight fin 7, with the first angled fin 9 being angled (in the transverse plane 11, which is shown in FIG. 1, with respect to the body 2 of the slat 1) at an angle α' toward the rear face 4 of the body 2. Similarly, a second straight fin 12 having a first end 13 and a second angled fin 14 having a first end 15 are attached by their respective first ends 13, 15 to the second edge 6 with the first end 15 of the second angled fin 14 being no closer to the rear face 4 than is the first end 13 of the second straight fin 12, with the second angled fin 14 being angled (in the transverse plane 11 with respect to the body 2 of the slat 1) at an angle α" toward the front face 3 of the body 2 Optionally the fins 7, 9, 12, 14 can be integrally formed with the body 2.

In accordance with tradition for fins 7, 9, 12, 14 and slats 1 and as illustrated in FIG. 1, the connection of the fins 7, 9, 12, 14 to the body 2 of the slat 1 extends longitudinally along the edges 5, 6 of the body 2 of the slat 1.

The body 2 may be either solid or hollow and is preferably hollow, as illustrated in FIGS. 1 through 11. When the body 2 is hollow, such body 2 is preferably comprised of the first edge 5 connecting a first side 16 of the front face 3 to a first side 17 of the rear face 4 and with the second edge 6 connecting a second side 18 of the front face 3 to a second side 19 of the rear face 4, preferably by having a front end 20 of the first edge 5 connected to the first side 16 of the front face 3, a rear end 21 of the first edge 5 attached to the first side 17 of the rear face 4, a front end 22 of the second edge 6 attached to the second side 18 of the front face 3, and a rear end 23 of the second edge 6 connected to the second side 19 of the rear face 4. And most preferably, the hollow body 2 contains at least one and, preferably, two internal walls 24, 25 which are preferably parallel to the edges 5, 6 of the body 2 of the slat 1. The front end 26 of the first wall 24 is attached to the front face 3 of the body 2, and the rear end 27 of the first wall 24 is connected to the rear face 4. Similarly, the front end 28 of the second wall 25 is attached to the front face 3 of the body 2, and the rear end 29 of the second wall 25 is connected to the rear face 3. All component of the hollow body 2 are preferably integrally formed.

The free end 30 of the first straight fin 7 must be closer to the plane 31 containing the front face 3 of the body 2 of the slat 1 than is the free end 32 of the first angled fin 9. And the free end 33 of the second straight fin 12 must be closer to the plane 34 containing the rear face 4 of the body 2 of the slat 1 than is the free end 35 of the second angled fin 14.

Furthermore, neither the first straight fin 7 nor the first angled fin 9 can be attached to the first edge 5 more than halfway from the front face 3 to the rear face 4, and neither the second straight fin 12 nor the second angled fin 14 can be attached to the second edge 6 more than halfway from the rear face 4 to the front face 3.

Figure 2:
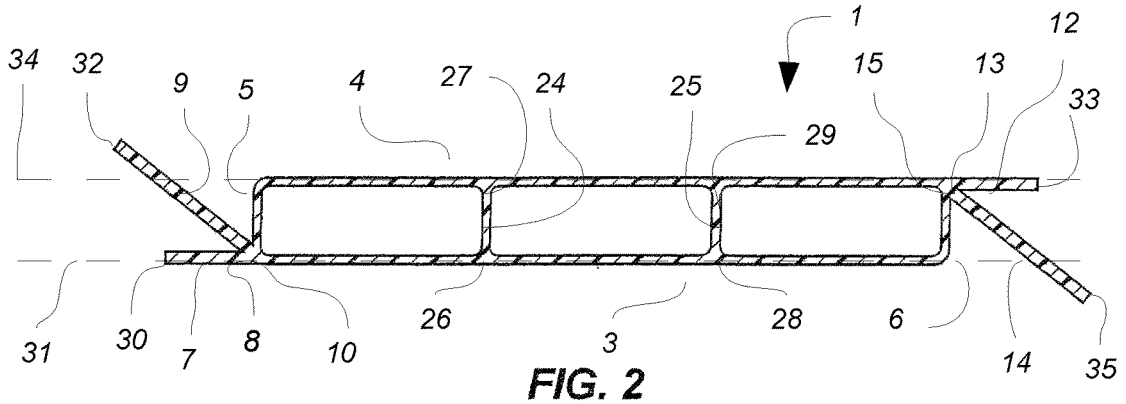
FIG. 2 is a cross-sectional transverse view of the Dual-winged Slat wherein (a) the first straight wing and the first angled wing are each attached to the body of the slat where the first edge and the front face of the slat intersect and wherein (b) the second straight wing and the second angled wing are each attached to the body of the slat where the second edge and the rear face of the body of the slat intersect.
Figure 3:
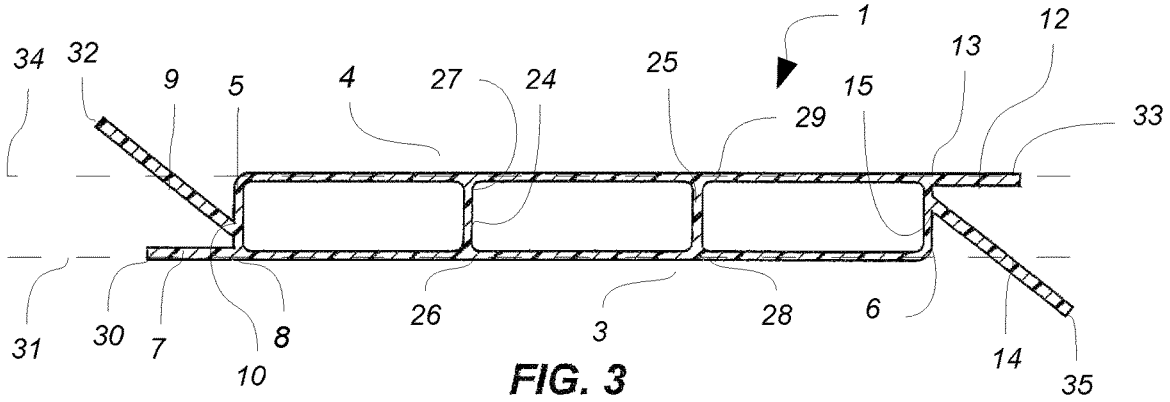
FIG. 3 is a cross-sectional transverse view of the Dual-winged Slat wherein the first straight wing is attached to the body of the slat where the first edge and the front face of the slat intersect, the second straight wing is attached to the body of the slat where the second edge and the rear face of the body of the slat intersect, the first angled wing is attached to the first edge farther toward the transverse center of the first edge than is the first straight wing but not beyond the transverse center of the first edge, and the second angled wing is attached to the second edge farther toward the transverse center of the second edge than is the second straight wing but not beyond the transverse center of the second edge.
Figure 4:
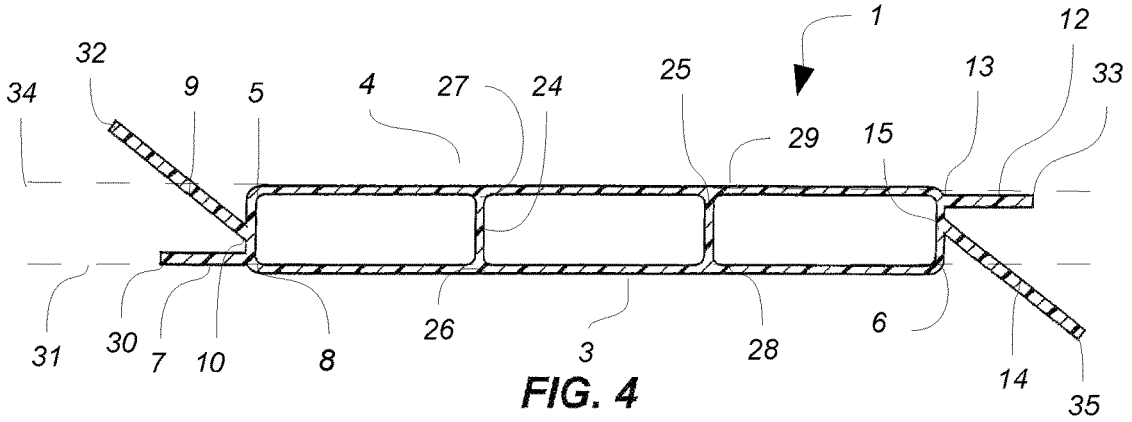
FIG. 4 is a cross-sectional transverse view of the Dual-winged Slat wherein the first straight wing is attached to the first edge farther toward the transverse center of the first edge than the front face but not so far as the transverse center of the first edge, the first angled wing is attached to the first edge farther toward the transverse center of the first edge than is the first straight wing but not farther than the transverse center of the first edge, the second straight wing is attached to the second edge farther toward the transverse center of the first edge than the rear face but not so far as the transverse center of the first edge, and the second angled wing is attached to the second edge farther toward the transverse center of the second edge than is the second straight wing but not farther than the transverse center of the first edge.
Figure 5:
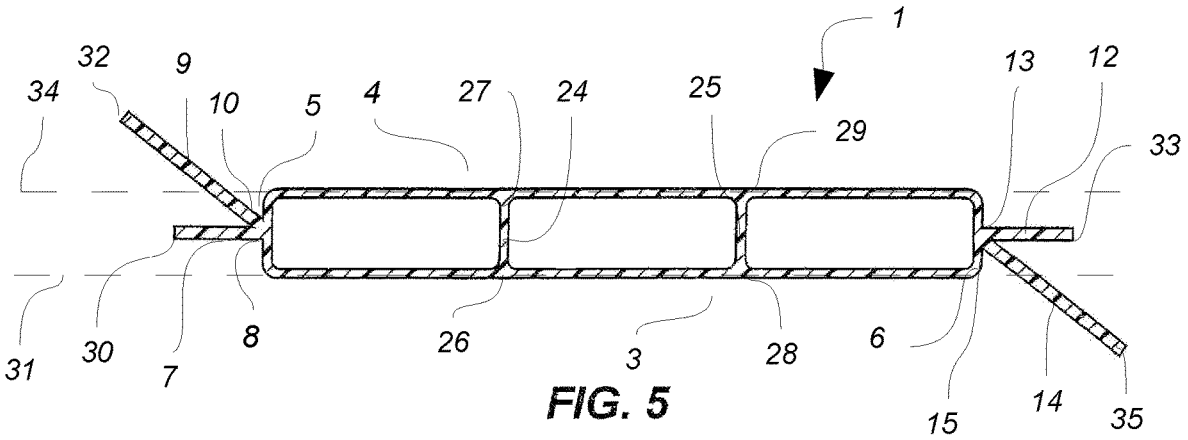
FIG. 5 is a cross-sectional transverse view of the Dual-winged Slat wherein the first straight wing and the first angled wing are both attached to the transverse center of the first edge, and the second straight wing and the second angled wing are both attached to the transverse center of the second edge.
Figure 6:
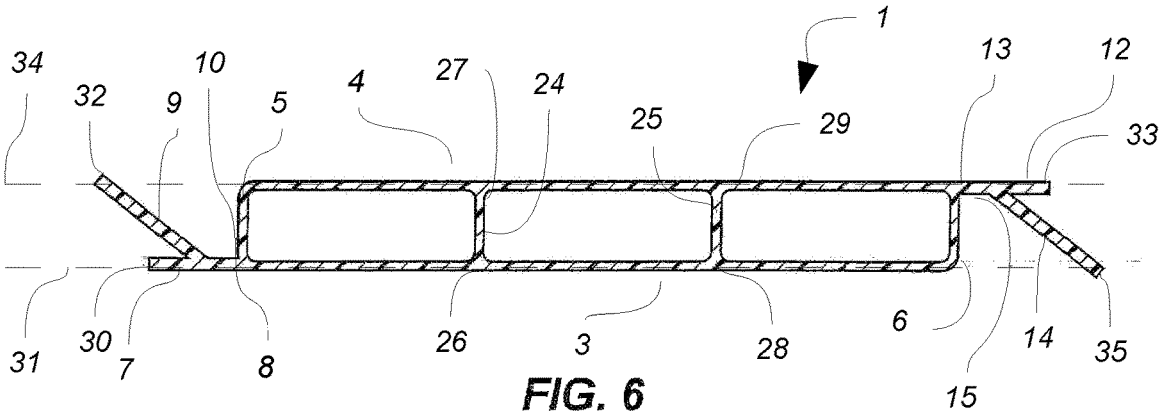
FIG. 6 is the same as FIG. 2 except that (1) the first angled wing comprises (a) a first portion which is straight, which is perpendicular to the first edge, and which is attached to the first edge and (b) a second portion with such second portion being angled toward the face of the slat which is farther from the point of attachment of the first angled fin to the first edge and with such second portion having the free end of the angled fin and (2) the second angled wing comprises (a) a first portion which is straight, which is perpendicular to the second edge, and which is attached to the second edge and (b) a second portion with such second portion being angled toward the face of the slat which is farther from the point of attachment of the angled fin to the second edge and with such second portion having the free end of the second angled fin.
Figure 7:
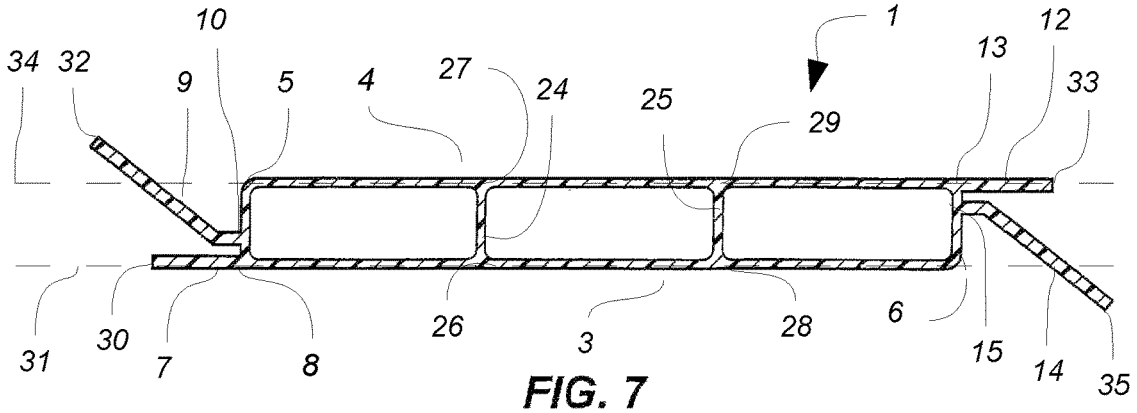
FIG. 7 is the same as FIG. 3 except that (1) the first angled wing comprises (a) a first portion which is straight, which is perpendicular to the first edge, and which is attached to the first edge and (b) a second portion with such second portion being angled toward the face of the slat which is farther from the point of attachment of the first angled fin to the first edge and with such second portion having the free end of the angled fin and (2) the second angled wing comprises (a) a first portion which is straight, which is perpendicular to the second edge, and which is attached to the second edge and (b) a second portion with such second portion being angled toward the face of the slat which is farther from the point of attachment of the angled fin to the second edge and with such second portion having the free end of the second angled fin.
Figure 8:
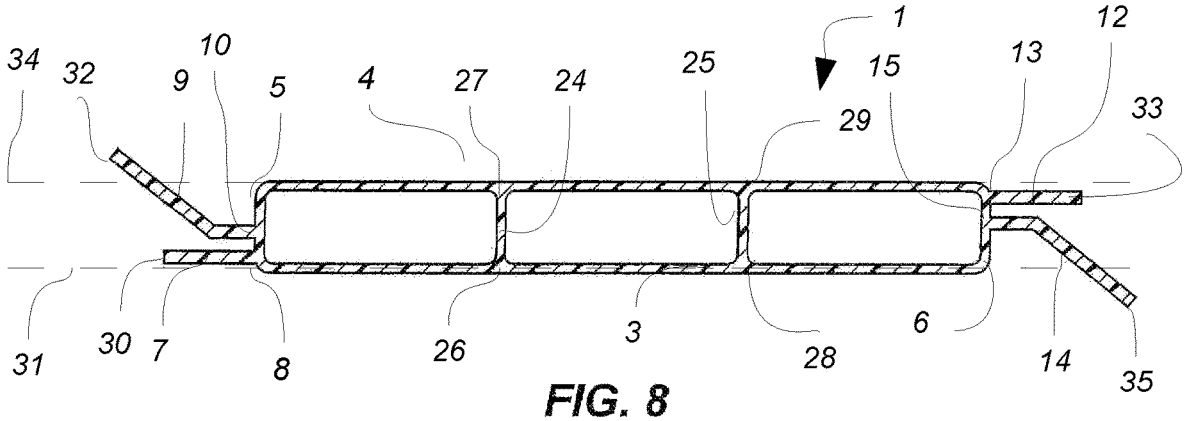
FIG. 8 is the same as FIG. 4 except that (1) the first angled wing comprises (a) a first portion which is straight, which is perpendicular to the first edge, and which is attached to the first edge and (b) a second portion with such second portion being angled toward the face of the slat which is farther from the point of attachment of the first angled fin to the first edge and with such second portion having the free end of the angled fin and (2) the second angled wing comprises (a) a first portion which is straight, which is perpendicular to the second edge, and which is attached to the second edge and (b) a second portion with such second portion being angled toward the face of the slat which is farther from the point of attachment of the angled fin to the second edge and with such second portion having the free end of the second angled fin.
Figure 9:
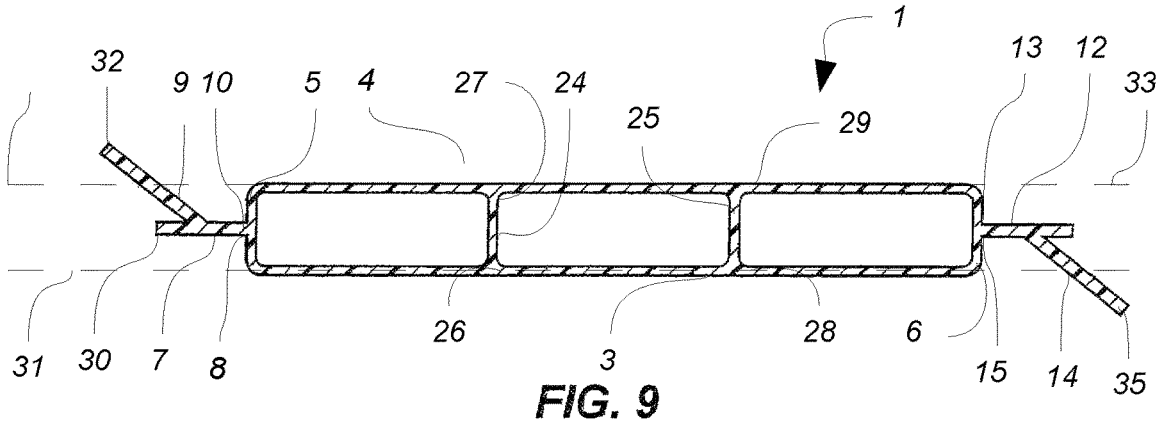
FIG. 9 is the same as FIG. 5 except that (1) the first angled wing comprises (a) a first portion which is straight, which is perpendicular to the first edge, and which is attached to the first edge and (b) a second portion with such second portion being angled toward the face of the slat which is farther from the point of attachment of the first angled fin to the first edge and with such second portion having the free end of the angled fin and (2) the second angled wing comprises (a) a first portion which is straight, which is perpendicular to the second edge, and which is attached to the second edge and (b) a second portion with such second portion being angled toward the face of the slat which is farther from the point of attachment of the angled fin to the second edge and with such second portion having the free end of the second angled fin.

Preferably, as illustrated in FIGS. 1, 2, and 4, the first straight fin 7 and the first angled fin 9 are attached to the first edge 5 at the same place of the first edge 5; and the second straight fin 12 and the second angled fin 14 are attached to the second edge 6 at the same place of the second edge 6.

The fins 7, 9, 12, 14 are, preferably, asymmetrically arranged, i.e., as indicated above, the first straight fin 7 is diagonally opposite to the second straight fin 12, and the first angled fin 9 is diagonally opposite to the second angled fin 14. And even more preferably, the fins 7, 9, 12, 14 are precisely asymmetrically arranged, i.e., as defined herein, the fins 7, 9, 12, 14 are not only asymmetrically arranged as stated in the immediately preceding sentence, but the first straight fin 7 is the same distance from the front face 3 as the second straight fin 12 is from the rear face 4 while the first angled fin 9 is the same distance from the front face 3 as the second angled fin 14 is from the rear face 4.

Figure 11:
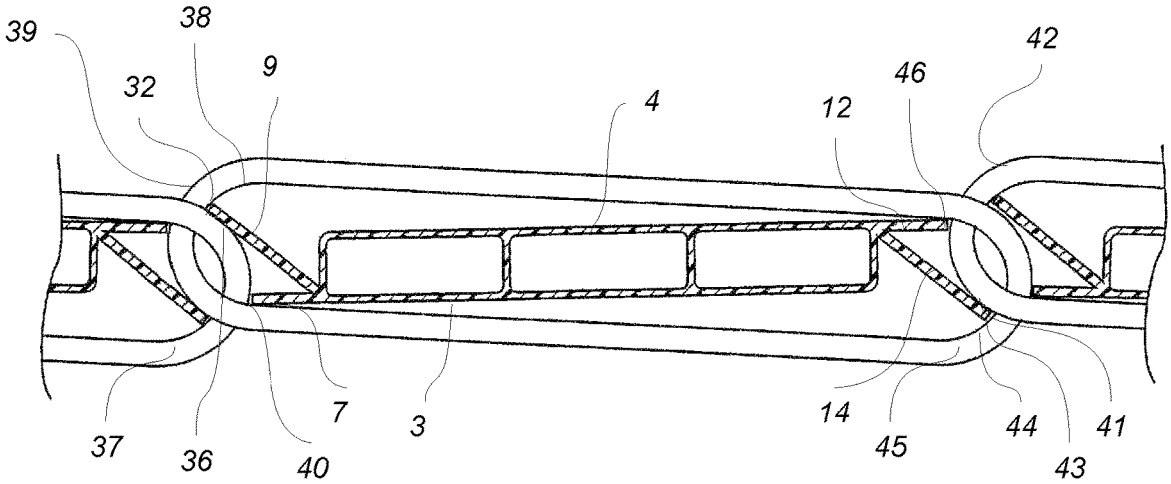
FIG. 11 is a plan view from above showing within a channel between the knuckles of the chain link fence an embodiment of the Dual-winged Slat with the first angled fin riding along the outer rear portion of the first left-opening curved knuckle, the free end of the first angled fin touching the inside of the first right-opening curved knuckle, the first straight fin being outside and touching the front outer portion of the first left-opening curved knuckle, the second angled fin riding along the outer front portion of the second right-opening curved knuckle, the second angled fin touching the inside of the second left-opening curved knuckle, and the second straight fin being outside and touching the rear outer portion of the second right-opening curved knuckle.
Figure 10:
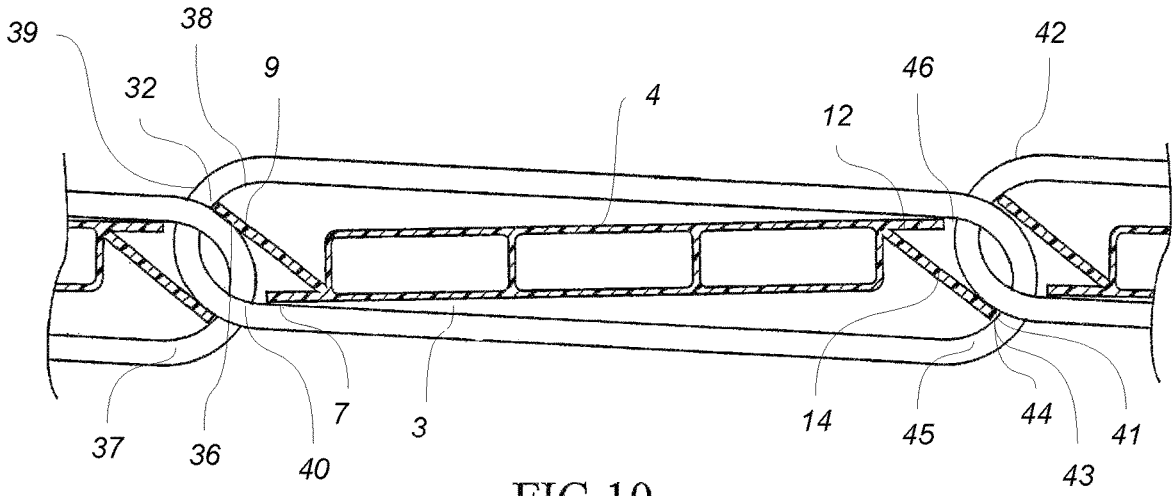
FIG. 10 is a plan view from above showing within a channel between the knuckles of the chain link fence an embodiment of the Dual-winged Slat with the first angled fin riding along the outer rear portion of the first left-opening curved knuckle, the free end of the first angled fin touching the inside of the first right-opening curved knuckle, the first straight fin being outside but near the front outer portion of the first left-opening curved knuckle, the second angled fin riding along the outer front portion of the second right-opening curved knuckle, the second angled fin touching the inside of the second left-opening curved knuckle, and the second straight fin being outside but near the rear outer portion of the second right-opening curved knuckle.

Preferably and as illustrated in FIG. 10, for the angled fin 9 and the straight fin 7 which are closer to the front face 3, i.e., the first straight fin 7 and the first angled fin 9, the first angled fin 9 rides along the outer rear portion 36 of the first left-opening curved knuckle 37, the free end 32 of the first angled fin 9 touches the inside 38 of the first right-opening curved knuckle 39, and the first straight fin 7 must be outside but near (and, most preferably, as shown in FIG. 11, touch) the front outer portion 40 of the first left-opening curved knuckle 37. Also preferably, for the angled fin 14 and the straight fin 12 which are closer to the rear face 4, i.e., the second angled fin 14 and the second straight fin 12, the second angled fin 14 rides along the outer front portion 41 of the second right-opening curved knuckle 42, the free end 43 of the second angled fin 14 touches the inside 44 of the second left-opening curved knuckle 45, and the second straight fin 12 must be outside but near (and, most preferably, as portrayed in FIG. 11, touch) the rear outer portion 46 of the second right-opening curved knuckle 42.

As portrayed in FIGS. 1, 2, 3, 10, and 14, the first straight fin 7 is preferably aligned with the front face 3 of the body 2 of the slat 1, and the second straight fin 12 is preferably aligned with the rear face 4 of the body 2 of the slat 1.

Also preferably, as depicted in FIG. 2, the angle α' between the first angled fin 9 and a plane 31 containing the front face 3 is the same as the angle α" between the second angled fin 14 and a plane 34 containing the rear face 4. And, as illustrated in FIGS. 1 through 11, preferably, the length of the first straight fin 7 is the same as the length of the second straight fin 12 (All lengths mentioned in this paragraph and the next paragraph are measured in the transverse plane 11.); and, preferably, the length of the first angled fin 9 is the same as the length of the second angled fin 14. (The largest dimension of the body 2 of the slat 1 and of the fins 7, 9, 12, 14 is the height, which is the dimension perpendicular to the transverse plane 11.)

Although the slat 1 can be constructed to fit a chain link fence of any mesh size, for a 3.5 and 5 mesh chain link fence illustrative dimensions for a slat 1 which would utilize the preferred limitations and, when most preferred limitations have been mentioned, such most preferred limitations are the following: the body 2 of the slat 1 would be 2 inches long and 0.25 inches wide, i.e., the first edge 5, the second edge 6, and the internal walls 24, 25 would be 0.25 inches long; the front face 3, the rear face 4, the first edge 5, the second edge 6, and the internal walls 24, 25 would be 0.025 inches wide; the straight fins 7, 12 would be 0.25 inches long and 0.035 inches wide; and the angled fins 9, 14 would be 0.5 inches long and 0.035 inches wide. Of these lengths and widths as well as the angles α', α" only the length of the body 2 would have to vary when the mesh of the chain link fence is different.

The angles α', α" are preferably within the range of 35° to 38°, inclusive; and, most preferably, each of these angles is 37°. Furthermore, as shown in FIGS. 6 through 9, the first angled fin 9 can initially extend perpendicularly to the first edge 5 before being bent to angle toward the rear face 4; and the second angled fin 14 can initially extend perpendicularly to the second edge 6 prior to being bent to angle toward the front face 3. In such a case, the values of the angles α', α" would differ from those stated earlier in this paragraph.

Figure 12:
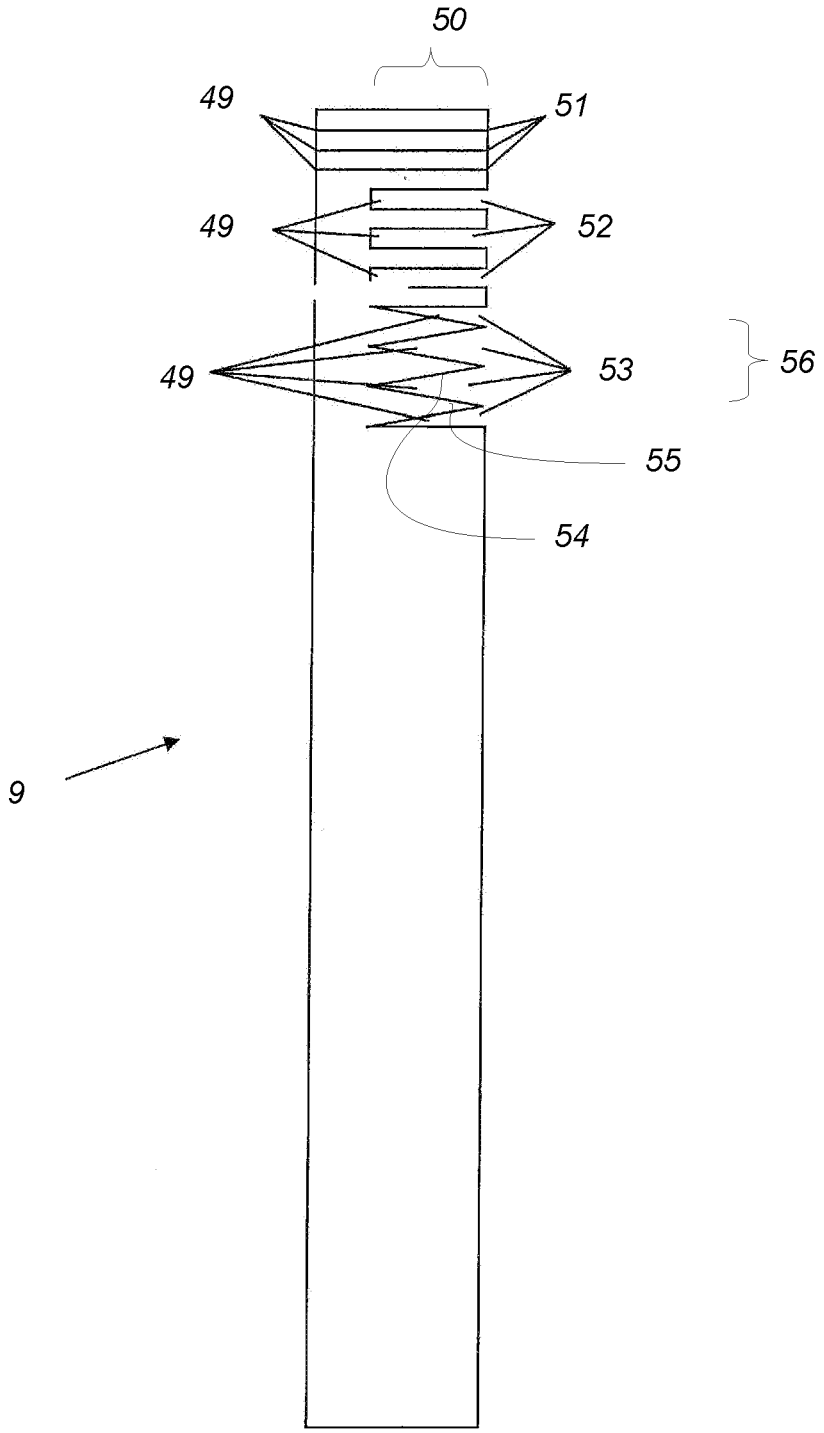
FIG. 12 shows the first angled fin containing one or more separations.

Each fin 7, 9, 12, 14, i.e., the first straight fin 7, the first angled fin 9, the second straight fin 12, and the second angled fin 14, optionally contains one or more separations 49, as illustrated in FIG. 12 for the first angled fin 9.

Such separations 49 can extend across the full length of each fin 7, 9, 12, 14 or only across part of the length of such fin 7, 9, 12, 14 and can extend the full width of each fin 7, 9, 12, 14 or only a final segment 50 of the width of such fin 7, 9, 12, 14. Furthermore, some of such separations 49 can extend the full width of such fin 7, 9, 12, 14 while other separations 49 extend across only a final segment 50 of such fin 7, 9, 12, 14.

The separation 49 can be a slit 51, a gap 52, or a notch 53 (a gap 52 with sides 54, 55 which are not parallel to one another, e.g., serrations 56). A single fin 7, 9, 12, 14 can have only one type of separation 49 or any combination of different types of separations 49.

Whenever it is stated herein that a component which is indicated to be attached or connected can be, or is preferably, integrally formed, "integrally formed" is defined herein to comprise "attached" or "connected" in addition to meaning "formed as a single unit."

As used herein the term "preferable" or "preferably" means that a specified element or technique is more acceptable than another but not that such specified element or technique is a necessity.

As used herein, the terms "straight" (as in "straight fin"), "rectangular", "angled", "perpendicular", "perpendicularly, "bent", "aligned" and the like are to be construed as being preceded in all cases by the adjective "generally". More specifically, in various embodiments herein and other embodiments not expressly described or illustrated, elements of the present invention are constructed of materials, which by their nature, may flex, bend, distort, and/or or depart from their original fixed and/or molded shapes. This bending or departure from original shape does not represent a departure from the purposes or scope of the invention or the claims set forth below, but rather, are still expressly claimed herein. The term "generally" is defined herein as +/−49% of the stated value or characteristic.

I claim:

1. A dual-winged slat for a chain link fence, which comprises:

a rectangular body, which comprises:

a front face having a first side and a second side;

a first edge having a front end and a rear end with the front end of the first edge connected to the first side of the front face;

a rear face having a first side and a second side with the first side of the rear face attached to the rear end of the first edge; and a second edge having a front end and a rear end with the front end of the second edge attached to the second side of the front face and with the rear end of the second edge connected to the second side of the rear face;

a first straight fin having a first end and a free end with the first end of said first straight fin attached to the first edge of said rectangular body no farther than halfway from the front face toward the rear face, the first straight fin extending generally perpendicularly from the first edge and generally parallel to a plane generally containing the front face;

a first angled fin having a first end and a tree end, the first end of said first angled fin being attached to the first edge of said rectangular body no closer to the front face than is the first end of said first straight fin, said first angled fin extending from the first edge generally at an angle to a plane generally containing the front face and toward the rear face, and the free end of said first angled fin being farther from the front face than is the free end of said first straight fin;

a second straight fin having a first end and a free end with the first end of said second straight fin attached to the second edge of said rectangular body no farther than halfway from the rear face toward the front face, the second straight fin extending generally perpendicularly from the second edge and generally parallel to a plane generally containing the rear face; and a second angled fin having a first end and a free end, the first end of said second angled fin being attached to the second edge of said rectangular body no closer to the rear face than is the first end of said second straight fin, said second angled fin extending from the second edge generally at an angle to a plane generally containing the rear face and toward the front face, and the free end of said second angled fin being farther from the rear face than is the free end of said first straight fin.

2. The dual-winged slat for a chain link fence as recited in claim 1, wherein:

said first straight fin, said first angled fin, said second straight fin, and said second angled fin are precisely asymmetrically arranged;

said first angled fin rides along an outer rear portion of a first left-opening curved knuckle of a chain link fence;

the free end of said first angled fin touches an inside of a first right-opening curved knuckle of the chain link fence;

said first straight fin is outside but near a front outer portion of the first left-opening curved knuckle of the chain link fence;

said second angled fin rides along an outer front portion of a second right-opening curved knuckle of the chain link fence;

the free end of said second angled fin touches an inside of a second left-opening curved knuckle of the chain link fence; and said second straight fin is outside but near a rear outer portion of the second right-opening curved knuckle of the chain link fence.

3. The dual-winged slat for a chain link fence as recited in claim 2, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

4. The dual-winged slat for a chain link fence as recited in claim 2, wherein:

said first straight fin is aligned with the front face of said rectangular body;

said second straight fin is aligned with the rear face of said rectangular body;

the angle between said first angled fin and a plane containing the front face of said rectangular body is the same as the angle between said second angled fin and a plane containing the rear face of said rectangular body;

the length of said first straight fin is the same as the length of said second straight fin; and the length of said first angled fin is the same as the length of said second angled fin.

5. The dual-winged slat for a chain link fence as recited in claim 4, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

6. The dual-winged slat for a chain link fence as recited in claim 4, wherein:

the free end of said first angled fin is angled toward the rear face at an angle of 37°; and the free end of said second angled fin is angled toward the front face at an angle of 37°.

7. The dual-winged slat for a chain link fence as recited in claim 4, wherein:

said first angled fin initially extends perpendicularly to the first edge of said rectangular body before being bent to angle toward the rear face of said rectangular body; and said second angled fin initially extends perpendicularly to the second edge of said rectangular body before being bent to angle toward the front face of said rectangular body.

8. The dual-winged slat for a chain link fence as recited in claim 1, wherein:

said first straight fin, said first angled fin, said second straight fin, and said second angled fin are precisely asymmetrically arranged;

said first angled fin rides along an outer rear portion of a first left-opening curved knuckle of a chain link fence;

the free end of said first angled fin touches an inside of a first right-opening curved knuckle of the chain link fence;

said first straight fin is outside but touches a front outer portion of the first left-opening curved knuckle of the chain link fence;

said second angled fin rides along an outer front portion of a second right-opening curved knuckle of the chain link fence;

the free end of said second angled fin touches an inside of a second left-opening curved knuckle of the chain link fence; and said second straight fin is outside but touches a rear outer portion of the second right-opening curved knuckle of the chain link fence.

9. The dual-winged slat for a chain link fence as recited in claim 8, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

10. The dual-winged slat for a chain link fence as recited in claim 8, wherein:

said first straight fin is aligned with the front face of said rectangular body;

said second straight fin is aligned with the rear face of said rectangular body;

the angle between said first angled fin and a plane containing the front face of said rectangular body is the same as the angle between said second angled fin and a plane containing the rear face of said rectangular body;

the length of said first straight fin is the same as the length of said second straight fin; and the length of said first angled fin is the same as the length of said second angled fin.

11. The dual-winged slat for a chain link fence as recited in claim 10, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

12. The dual-winged slat for a chain link fence as recited in claim 10, wherein:

the free end of said first angled fin is angled toward the rear face at an angle of 37°; and the free end of said second angled fin is angled toward the front face at an angle of 37°.

13. The dual-winged slat for a chain link fence as recited in claim 10, wherein:

said first angled fin initially extends perpendicularly to the first edge of said rectangular body before being bent to angle toward the rear face of said rectangular body; and said second angled fin initially extends perpendicularly to the second edge of said rectangular body before being bent to angle toward the front face of said rectangular body.

14. The dual-winged slat for a chain link fence as recited in claim 1, wherein:

said first straight fin, said first angled fin, said second straight fin, and said second angled fin are precisely asymmetrically arranged;

said first straight fin and said first angled fin are attached to the first edge of said rectangular body at the same place on the first edge;

said second straight fin and said second angled fin are attached to the second edge of said rectangular body at the same place on the second edge;

said first angled fin rides along an outer rear portion of a first left-opening curved knuckle of a chain link fence;

the free end of said first angled fin touches an inside of a first right-opening curved knuckle of the chain link fence;

said first straight fin is outside but near a front outer portion of the first left-opening curved knuckle of the chain link fence;

said second angled fin rides along an outer front portion of a second right-opening curved knuckle of the chain link fence;

the free end of said second angled fin touches an inside of a second left-opening curved knuckle of the chain link fence; and said second straight fin is outside but near a rear outer portion of the second right-opening curved knuckle of the chain link fence.

15. The dual-winged slat for a chain link fence as recited in claim 14, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

16. The dual-winged slat for a chain link fence as recited in claim 14, wherein:

said first straight fin is aligned with the front face of said rectangular body;

said second straight fin is aligned with the rear face of said rectangular body;

the angle between said first angled fin and a plane containing the front face of said rectangular body is the same as the angle between said second angled fin and a plane containing the rear face of said rectangular body;

the length of said first straight fin is the same as the length of said second straight fin; and the length of said first angled fin is the same as the length of said second angled fin.

17. The dual-winged slat for a chain link fence as recited in claim 16, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

18. The dual-winged slat for a chain link fence as recited in claim 16, wherein:

the free end of said first angled fin is angled toward the rear face at an angle of 37°; and the free end of said second angled fin is angled toward the front face at an angle of 37°.

19. The dual-winged slat for a chain link fence as recited in claim 1, wherein:

said first straight fin, said first angled fin, said second straight fin, and said second angled fin are precisely asymmetrically arranged;

said first straight fin and said first angled fin are attached to the first edge of said rectangular body at the same place on the first edge;

said second straight fin and said second angled fin are attached to the second edge of said rectangular body at the same place on the second edge;

said first angled fin rides along an outer rear portion of a first left-opening curved knuckle of a chain link fence;

the free end of said first angled fin touches an inside of a first right-opening curved knuckle of the chain link fence;

said first straight fin is outside but touches a front outer portion of the first left-opening curved knuckle of the chain link fence;

said second angled fin rides along an outer front portion of a second right-opening curved knuckle of the chain link fence;

the free end of said second angled fin touches an inside of a second left-opening curved knuckle of the chain link fence; and said second straight fin is outside but touches a rear outer portion of the second right-opening curved knuckle of the chain link fence.

20. The dual-winged slat for a chain link fence as recited in claim 19, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

21. The dual-winged slat for a chain link fence as recited in claim 19, wherein:

said first straight fin is aligned with the front face of said rectangular body;

said second straight fin is aligned with the rear face of said rectangular body;

the angle between said first angled fin and a plane containing the front face of said rectangular body is the same as the angle between said second angled fin and a plane containing the rear face of said rectangular body;

the length of said first straight fin is the same as the length of said second straight fin; and the length of said first angled fin is the same as the length of said second angled fin.

22. The dual-winged slat for a chain link fence as recited in claim 21, wherein:

the free end of said first angled fin is angled toward the rear face at an angle which is with a range of 35° to 38°, inclusive; and the free end of said second angled fin is angled toward the front face at an angle which is with a range of 35° to 38°, inclusive.

23. The dual-winged slat for a chain link fence as recited in claim 21, wherein:

the free end of said first angled fin is angled toward the rear face at an angle of 37°; and the free end of said second angled fin is angled toward the front face at an angle of 37°.

24. A dual-winged slat for a chain link fence, which comprises:

a rectangular body, which comprises:

a front face having a first side and a second side;

a first edge having a front end and a rear end with the front end of the first edge connected to the first side of the front face;

a rear face having a first side and a second side with the first side of the rear face attached to the rear end of the first edge; and a second edge having a front end and a rear end with the front end of the second edge attached to the second side of the front face and with the rear end of the second edge connected to the second side of the rear face;

a first straight fin having a first end and a free end with the first end of said first straight fin attached to the first edge of said rectangular body no farther than halfway from the front face toward the rear face, the first straight fin extending generally perpendicularly from the first edge and generally parallel to a plane generally containing the front face;

a first angled fin having a first end and a free end, the first end of said first angled fin being attached to the first edge of said rectangular body no closer to the front face than is the first end of said first straight fin, said first angled fin extending from the first edge generally at an angle to a plane generally containing the front face and toward the rear face, and the free end of said first angled fin being farther from the front face than is the free end of said first straight fin;

a second straight fin having a first end and a free end with the first end of said second straight fin attached to the second edge of said rectangular body no farther than halfway from the rear face toward the front face, the second straight fin extending generally perpendicularly from the second edge and generally parallel to a plane generally containing the rear face; and a second angled fin having a first end and a free end, the first end of said second angled fin being attached to the second edge of said rectangular body no closer to the rear face than is the first end of said second straight fin, said second angled fin extending from the second edge generally at an angle to a plane generally containing the rear face and toward the front face, and the free end of said second angled fin being farther from the rear face than is the free end of said first straight fin, wherein:

said first straight fin, said first angled fin, said second straight fin, and said second angled fin are precisely asymmetrically arranged;

said first angled fin rides along an outer rear portion of a first left-opening curved knuckle of a chain link fence;

the free end of said first angled fin touches an inside of a first right-opening curved knuckle of the chain link fence;

said first straight fin is outside but near a front outer portion of the first left-opening curved knuckle of the chain link fence;

said second angled fin rides along an outer front portion of a second right-opening curved knuckle of the chain link fence;

the free end of said second angled fin touches an inside of a second left-opening curved knuckle of the chain link fence;

said second straight fin is outside but near a rear outer portion of the second right-opening curved knuckle of the chain link fence;

said first straight fin is aligned with the front face of said rectangular body;

said second straight fin is aligned with the rear face of said rectangular body;

the angle between said first angled fin and a plane containing the front face of said rectangular body is the same as the angle between said second angled fin and a plane containing the rear face of said rectangular body;

the length of said first straight fin is the same as the length of said second straight fin; and the length of said first angled fin is the same as the length of said second angled fin.

25. A dual-winged slat for a chain link fence, which comprises:

a rectangular body, which comprises:

a front face having a first side and a second side;

a first edge having a front end and a rear end with the front end of the first edge connected to the first side of the front face;

a rear face having a first side and a second side with the first side of the rear face attached to the rear end of the first edge; and a second edge having a front end and a rear end with the front end of the second edge attached to the second side of the front face and with the rear end of the second edge connected to the second side of the rear face;

a first straight fin having a first end and a free end with the first end of said first straight fin attached to the first edge of said rectangular body no farther than halfway from the front face toward the rear face, the first straight fin extending generally perpendicularly from the first edge and generally parallel to a plane generally containing the front face;

a first angled fin having a first end and a free end, the first end of said first angled fin being attached to the first edge of said rectangular body no closer to the front face than is the first end of said first straight fin, said first angled fin extending from the first edge generally at an angle to a plane generally containing the front face and toward the rear face, and the free end of said first angled fin being farther from the front face than is the free end of said first straight fin;

a second straight fin having a first end and a free end with the first end of said second straight fin attached to the second edge of said rectangular body no farther than halfway from the rear face toward the front face, the second straight fin extending generally perpendicularly from the second edge and generally parallel to a plane generally containing the rear face; and a second angled fin having a first end and a free end, the first end of said second angled fin being attached to the second edge of said rectangular body no closer to the rear face than is the first end of said second straight fin, said second angled fin extending from the second edge generally at an angle to a plane generally containing the rear face and toward the front face, and the free end of said second angled fin being farther from the rear face than is the free end of said first straight fin, wherein:

said first straight fin, said first angled fin, said second straight fin, and said second angled fin are precisely asymmetrically arranged;

said first straight fin and said first angled fin are attached to the first edge of said rectangular body at the same place on the first edge;

said second straight fin and said second angled fin are attached to the second edge of said rectangular body at the same place on the second edge;

said first angled fin rides along an outer rear portion of a first left-opening curved knuckle of a chain link fence;

the free end of said first angled fin touches an inside of a first right-opening curved knuckle of the chain link fence;

said first straight fin is outside but near a front outer portion of the first left-opening curved knuckle of the chain link fence;

said second angled fin rides along an outer front portion of a second right-opening curved knuckle of the chain link fence;

the free end of said second angled fin touches an inside of a second left-opening curved knuckle of the chain link fence;

said second straight fin is outside but near a rear outer portion of the second right-opening curved knuckle of the chain link fence;

said first straight fin is aligned with the front face of said rectangular body;

said second straight fin is aligned with the rear face of said rectangular body;

the angle between said first angled fin and a plane containing the front face of said rectangular body is the same as the angle between said second angled fin and a plane containing the rear face of said rectangular body;

the length of said first straight fin is the same as the length of said second straight fin; and the length of said first angled fin is the same as the length of said second angled fin.

26. A dual-winged slat for a chain link fence, which comprises:

a rectangular body, which comprises:

a front face having a first side and a second side;

a first edge having a front end and a rear end with the front end of the first edge connected to the first side of the front face;

a rear face having a first side and a second side with the first side of the rear face attached to the rear end of the first edge; and a second edge having a front end and a rear end with the front end of the second edge attached to the second side of the front face and with the rear end of the second edge connected to the second side of the rear face;

a first straight fin having a first end and a free end with the first end of said first straight fin attached to the first edge of said rectangular body no farther than halfway from the front face toward the rear face, the first straight fin extending generally perpendicularly from the first edge and generally parallel to a plane generally containing the front face;

a first angled fin having a first end and a free end, the first end of said first angled fin being attached to the first edge of said rectangular body no closer to the front face than is the first end of said first straight fin, said first angled fin extending from the first edge generally at an angle to a plane generally containing the front face and toward the rear face, and the free end of said first angled fin being farther from the front face than is the free end of said first straight fin;

a second straight fin having a first end and a free end with the first end of said second straight fin attached to the second edge of said rectangular body no farther than halfway from the rear face toward the front face, the second straight fin extending generally perpendicularly from the second edge and generally parallel to a plane generally containing the rear face; and a second angled fin having a first end and a free end, the first end of said second angled fin being attached to the second edge of said rectangular body no closer to the rear face than is the first end of said second straight fin, said second angled fin extending from the second edge generally at an angle to a plane generally containing the rear face and toward the front face, and the free end of said second angled fin being farther from the rear face than is the free end of said first straight fin, wherein:

said first straight fin, said first angled fin, said second straight fin, and said second angled fin are precisely asymmetrically arranged;

said first straight fin and said first angled fin are attached to the first edge of said rectangular body at the same place on the first edge;

said second straight fin and said second angled fin are attached to the second edge of said rectangular body at the same place on the second edge;

said first angled fin rides along an outer rear portion of a first left-opening curved knuckle of a chain link fence;

the free end of said first angled fin touches an inside of a first right-opening curved knuckle of the chain link fence;

said first straight fin is outside but touches a front outer portion of the first left-opening curved knuckle of the chain link fence;

said second angled fin rides along an outer front portion of a second right-opening curved knuckle of the chain link fence;

the free end of said second angled fin touches an inside of a second left-opening curved knuckle of the chain link fence;

said second straight fin is outside but touches a rear outer portion of the second right-opening curved knuckle of the chain link fence;

said first straight fin is aligned with the front face of said rectangular body;

said second straight fin is aligned with the rear face of said rectangular body;

the angle between said first angled fin and a plane containing the front face of said rectangular body is the same as the angle between said second angled fin and a plane containing the rear face of said rectangular body;

the length of said first straight fin is the same as the length of said second straight fin; and the length of said first angled fin is the same as the length of said second angled fin.

* * * * *